US005746634A

United States Patent [19]

Jankowski et al.

[11] Patent Number: 5,746,634

[45] Date of Patent: May 5, 1998

[54] PROCESS SYSTEM AND METHOD FOR FABRICATING SUBMICRON FIELD EMISSION CATHODES

[75] Inventors: Alan F. Jankowski, Livermore; Jeffrey P. Hayes, Ripon, both of Calif.

[73] Assignee: The Regents of the University of California, Oakland, Calif.

[21] Appl. No.: 627,152

[22] Filed: Apr. 3, 1996

[51] Int. Cl.[6] ..... H01J 9/02

[52] U.S. Cl. ..... 445/14; 445/50; 445/67; 427/78; 118/301

[58] Field of Search ..... 445/14, 50, 67; 427/77, 78; 118/301

[56] References Cited

U.S. PATENT DOCUMENTS

| | | | |
|---|---|---|---|
| 3,755,704 | 8/1973 | Spindt et al. | 313/309 |
| 3,812,559 | 5/1974 | Spindt et al. | 445/50 |
| 4,096,821 | 6/1978 | Greeneich et al. | 118/301 |
| 5,064,396 | 11/1991 | Spindt | 445/50 |
| 5,344,352 | 9/1994 | Horne et al. | 445/50 |
| 5,482,486 | 1/1996 | Vaudaine et al. | 445/50 |
| 5,584,739 | 12/1996 | Itoh et al. | 445/50 |

FOREIGN PATENT DOCUMENTS

| | | | |
|---|---|---|---|
| 93200841 | 3/1993 | European Pat. Off. . | |
| 53-93135 | 8/1978 | Japan | 427/78 |

OTHER PUBLICATIONS

G.N.A. van Veen, et al., "Collimated sputter deposition, a novel method for large area deposition of Spindt type field emission tips," J. Vac. Sci. Technol. B13, 478 (1995).

C. A. Spindt et al., "Physical properties of thin-film emission cathodes with molybdenum cones," J. Appl. Phys. 47, 5248 (1976).

C. A. Spindt et al., "Field-Emitter Arrays for Vacuum Microelectronics," IEEE Trans. Elec. Dev. 38, 2355 (1991).

C.O. Bozler et al., "Arrays of gated field-emitter cones having 0.32μm tip-to-tip spacing," J. Vac. Sci. Technol. B12, 629 (1994).

S.M. Rossnagel and J. Hopwood, "Metal ion deposition from ionized magnetron sputtering discharge," J. Vac. Sci. Technol. B12, 449 (1994).

C. A. Spindt, "A thin-film field-emission cathode," J. Appl. Phys. 39, 3504 (1968).

*Primary Examiner*—P. Austin Bradley
*Assistant Examiner*—Jeffrey T. Knapp
*Attorney, Agent, or Firm*—Henry P. Sartorio; Richard B. Main

[57] ABSTRACT

A process method and system for making field emission cathodes exists. The deposition source divergence is controlled to produce field emission cathodes with height-to-base aspect ratios that are uniform over large substrate surface areas while using very short source-to-substrate distances. The rate of hole closure is controlled from the cone source. The substrate surface is coated in well defined increments. The deposition source is apertured to coat pixel areas on the substrate. The entire substrate is coated using a manipulator to incrementally move the whole substrate surface past the deposition source. Either collimated sputtering or evaporative deposition sources can be used. The position of the aperture and its size and shape are used to control the field emission cathode size and shape.

4 Claims, 3 Drawing Sheets

PROCESS SYSTEM AND METHOD FOR FABRICATING SUBMICRON FIELD EMISSION CATHODES

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to microelectronics device fabrication and more particularly to methods and systems for making arrays of submicron field emission cathodes, or nanocones, on a substrate.

2. Description of the Background Art

The metallization of substrates with arrays of micron sized holes to fabricate field emission cathodes (FECs) has been demonstrated by conventional equipment that uses physical vapor deposition (PVD) evaporation processes. Conventional processes coat with very high uniformity tolerances using small divergence angles from a distant deposition source. Such requires a planetary fixture to manipulate the substrate and relatively long source-to-substrate distances.

FECs are characterized by cold emission, low voltage operation, high current density and microscopic size. In vacuum electronics, this makes them ideal in computer and television display screens. Conventional vacuum processing for the metallization steps used to fabricate FECs have relied on evaporative techniques to produce the sizes and shapes needed for efficient cathodes.

A typical field emission device comprises an insulating layer sandwiched between two conductive layers. A resistive layer is sometimes used as an intermediate layer above the bottom conducting layer. Micron diameter holes in the top conducting film allow for etching through the insulative layer to form an array of cavities. Vapor deposition processes, e.g., electron beam devices, are used to form metal cones through the holes at the bottom of each cavity. These cones serve as cathodes. Greater packing densities can be achieved with lower operating voltages when the holes and the tip-to-tip spacing of the cathodes can be reduced to 0.3 micrometers, or less. But such reductions in geometry increase the difficulties in using vapor deposition to form suitable cathodes through such small gate holes. For example, the source divergence must be reduced to prevent hole closure that can prevent the cathodes being formed from reaching an adequate cone height so very tall, e.g., over seven meters, vacuum chambers are needed to cope with such problems. Increasing the size of the area to be processed necessitates increasing the height of the vacuum chamber. So such conventional methods are at an end of their usefulness.

For further information on field emission devices, see, for example, U.S. Pat. No. 5,064,396, issued to C. Spindt on Nov. 12, 1991, U.S. Pat. No. 3,812,559, issued to C. Spindt on May 28, 1974, and U.S. Pat. No. 3,755,704, issued to C. Spindt on Aug. 28, 1973, each of which are incorporated herein by reference.

SUMMARY OF THE INVENTION

An object of the present invention is to provide a method fabricating submicron field emission cathodes over relatively large substrate surface areas.

Briefly, a process method for making field emission cathodes comprises controlling a deposition source divergence to produce field emission cathodes with height-to-base aspect ratios that are uniform over large substrate surface areas while using very short source-to-substrate distances. The rate of hole closure is controlled from the cone source. The substrate surface is coated in well defined increments. The deposition source is apertured to coat pixel areas on the substrate. The entire substrate is coated using a manipulator to incrementally move the whole substrate surface past the deposition source. Either collimated sputtering or evaporative deposition sources can be used. The position of the aperture and its size and shape are used to control the field emission cathode size and shape.

An advantage of the present invention is that a method of making field emission devices is provided that fabricates field emission cathodes with good cone geometries at submicron spacings.

Another advantage of the present invention is that a method of making field emission devices is provided that allows very large arrays of field emission devices to be fabricated on practically any size substrate.

A further advantage of the present invention is that a method of making field emission devices is provided that has a compact geometry for continuous and higher rate wafer throughput processing as compared to conventional planetary systems.

DETAILED DESCRIPTION OF THE INVENTION

Figure 1:
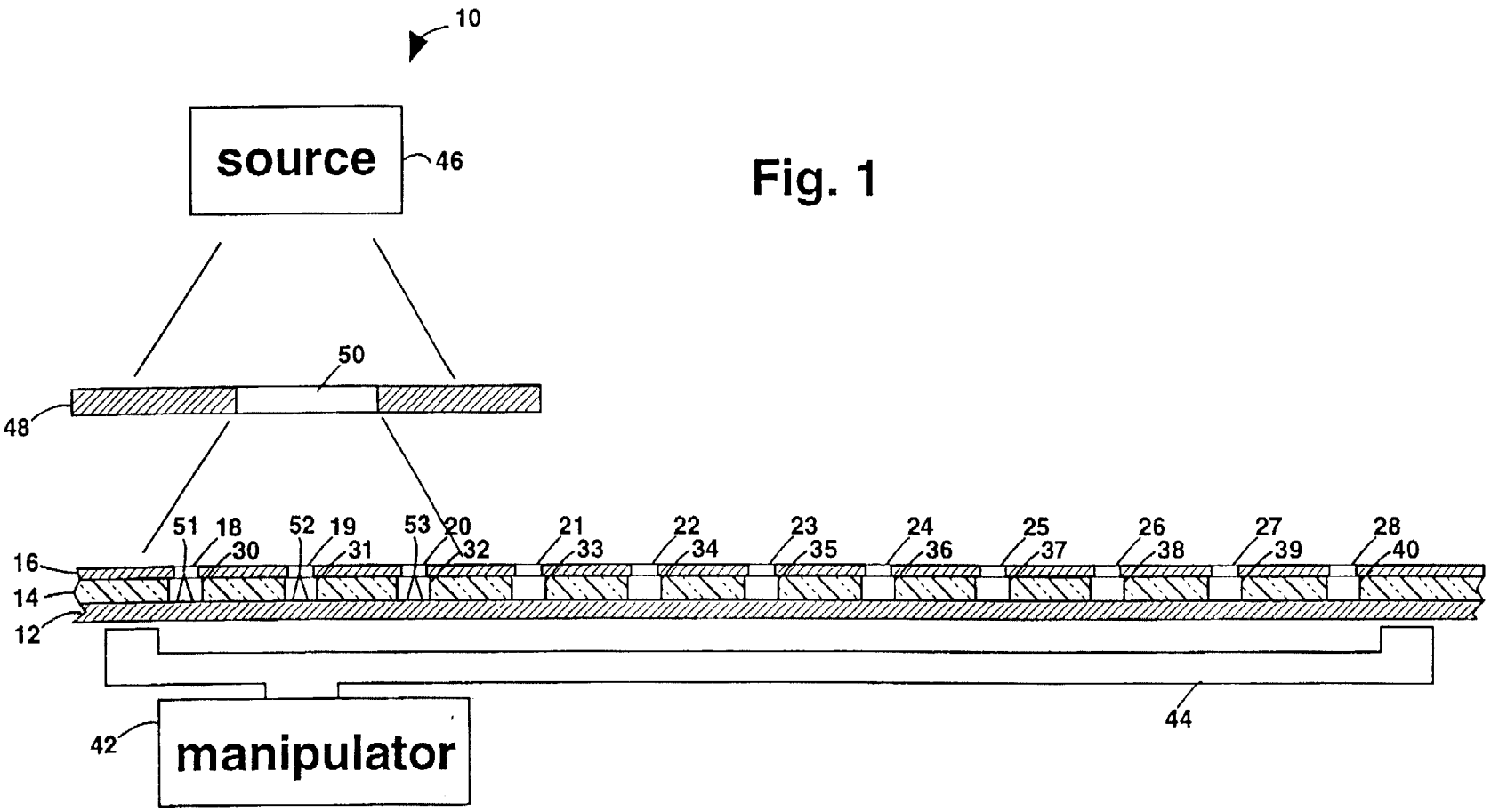
FIG. 1 is a diagram of a system embodiment of the present invention for fabricating submicron field emission cathodes at the bottoms of cavities through a first group of holes in a top layer.
Figure 2:
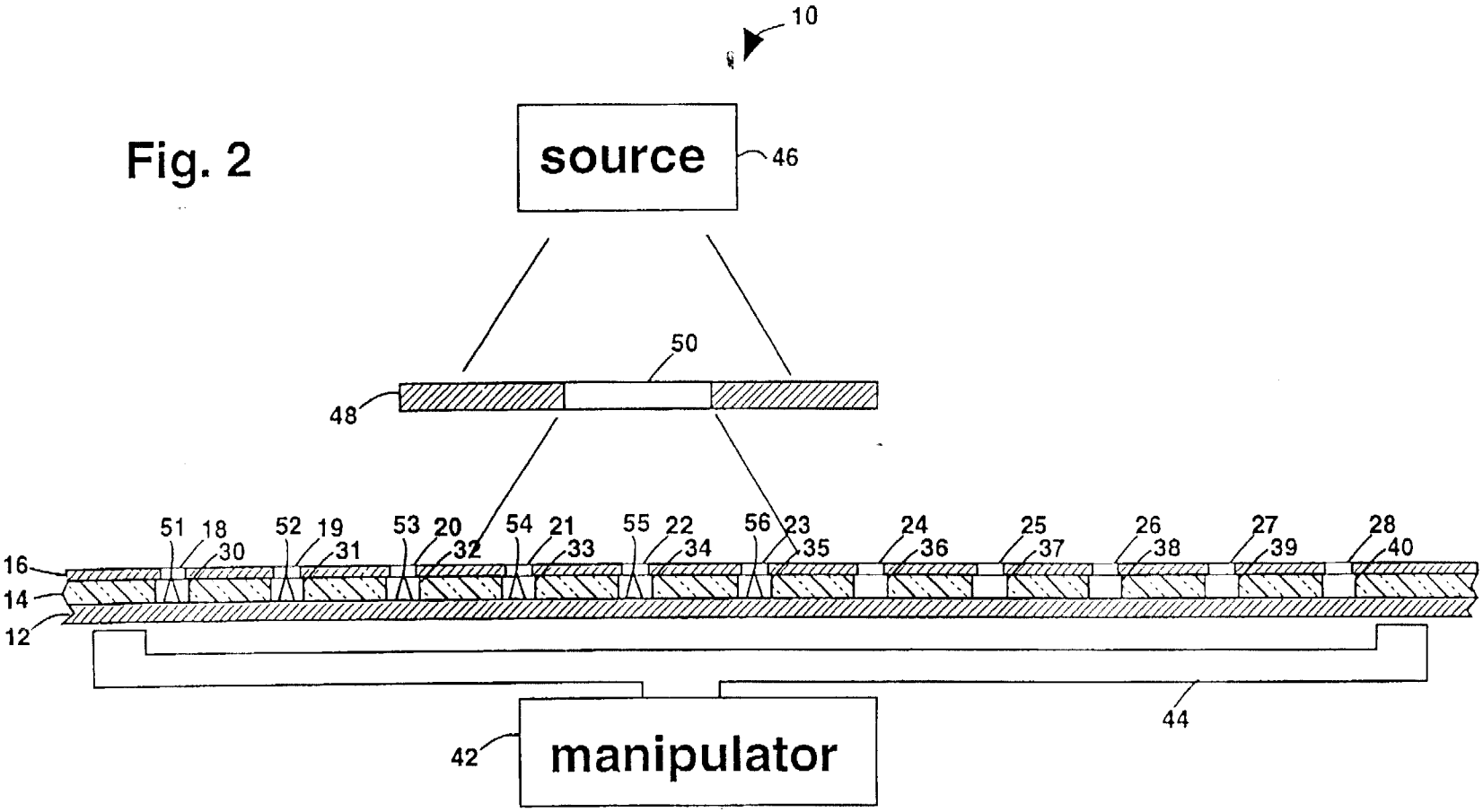
FIG. 2 shows the system of FIG. 1 fabricating submicron field emission cathodes at the bottoms of cavities through a second group of holes in the top layer.
Figure 3:
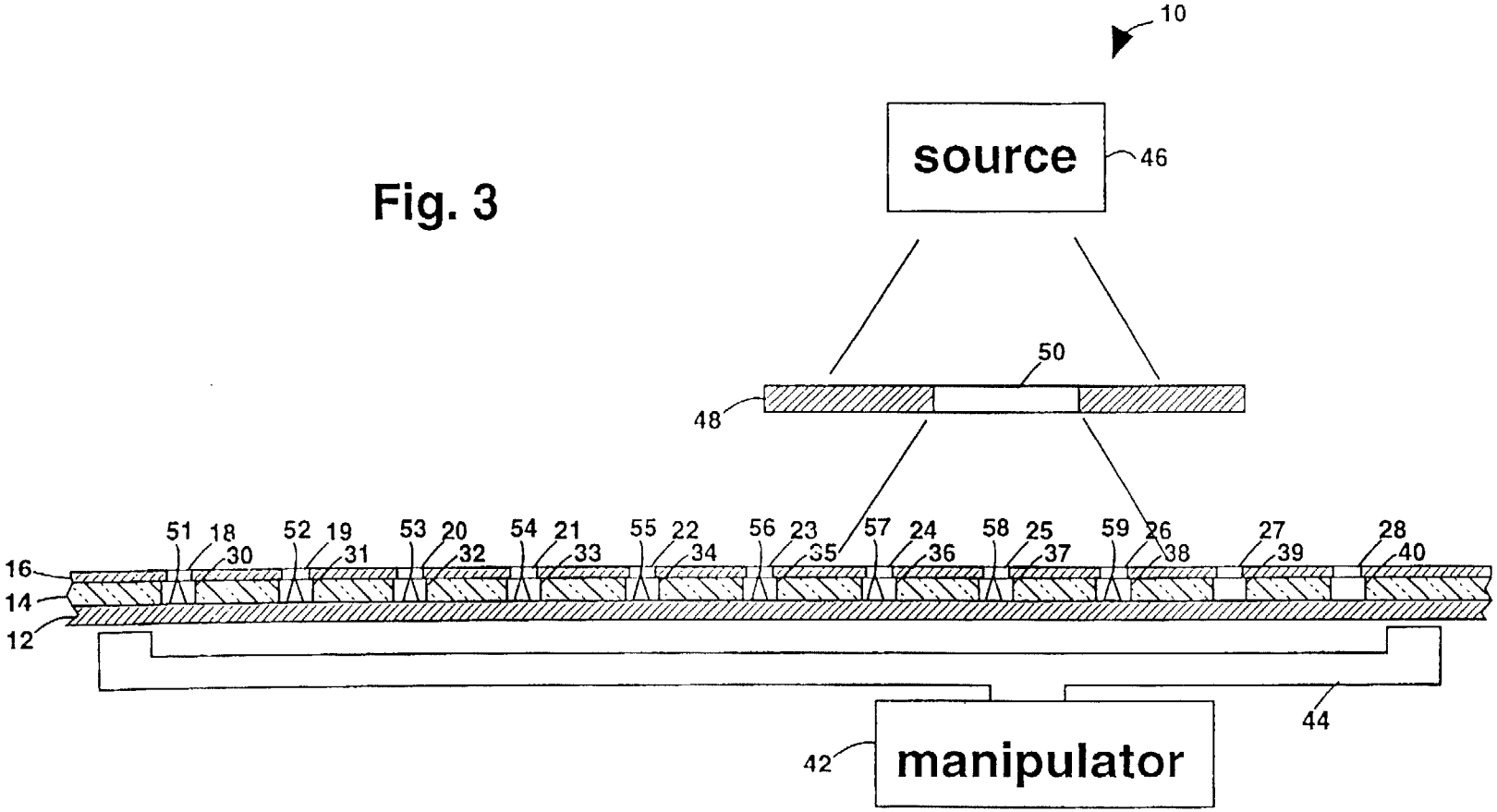
FIG. 3 shows the system of FIG. 1 fabricating submicron field emission cathodes at the bottoms of cavities through a third group of holes in the top layer.

FIGS. 1–3 illustrate a system of the present invention for fabricating field emission cathodes and is referred to herein by the general reference numeral 10. A substrate 12 forms a bottom conductive layer over which an insulative layer 14 and a top conductive layer 16 are formed. An array of holes 18–28 are opened up in the top conductive layer 16. The holes 18–28 are submicron in size and spacing, e.g., on the order of 300 nanometers. Beneath each hole 18–28 is a cavity 30–40 that extends down through the insulative layer 14 to the substrate 12. A three-axis manipulator 42 has a connection 44 to the substrate 12 that allows it to position the substrate 12 and its associated structures above a deposition source 46 that is located behind a shield 48 that has an aperture 50. Since the substrate 12 and its associated structures are positioned above the deposition source 46, contamination will fall away from the substrate 12. The source 46 can be either a collimated sputtering source or an evaporative deposition source. Electron beam evaporative sources have the advantage of being able to generate higher deposition rates than magnetron sputtering, for example. The relative position of the aperture 50 and its size and shape are controlled according to the desired shape of the field emission cathodes being formed.

FIG. 1 shows a first group of field emission cathodes, 51–53 being formed at the bottoms of their respective cavities 30–32. In a display application, each such field emission cathode is associated with a picture pixel. The size of the area on substrate 12 that can contain field emission cathodes thus fabricated is limited only by the range of the three-axis manipulator 42 and the limits of how large a substrate 12 can be made.

Rastering the substrate 12 over the deposition aperture 50 eliminates the field emission cathode eccentricities that would otherwise exist at the fringe areas of the deposition field. In conventional processes, the cone structures of each field emission cathode will be concentric with the hole in the center area of the substrate because the source appears near zenith for each hole. On the fringes, the source is not near zenith for each hole, so the cones that form are skewed to one side and have an eccentric shape.

FIG. 2 shows a second group of field emission cathodes, 54–56 being formed at the bottoms of their respective cavities 33–35 after the manipulator 42 has repositioned the substrate 12.

FIG. 3 shows a third group of field emission cathodes, 57–59 being formed at the bottoms of their respective cavities 36–38 after the manipulator 42 has once again repositioned the substrate 12.

For an electron-beam evaporative source 46, the substrate 12 will typically be placed three to twelve inches away, with 3.5 to 6.5 inches being optimal. The shield 48 will typically be positioned less than two inches from the substrate 12, with 0.50 inches, plus or minus 0.25 inches, being optimal. The aperture 50 is typically 0.25 to 1.50 inches in diameter, with 0.75 inches, plus or minus 0.25 inches, being optimal. The aperture 50 is not necessarily round, and different shapes may be used to produce field emission cathodes with desirable characteristics. Typical field emission cathodes will be cones with bases having a diameter of 3,000 Å, or less, and heights that range from 2,000 Åto 10,000 Å. For example, the forgoing separation distances and aperture sizes were used with a three-eighths inch rod of molybdenum as a metal source. The separation distances and aperture size for other types of sources, e.g., sputter deposition sources, will be different and can be empirically derived.

Although three-axis manipulators 42 have been described, one and two axis manipulators are preferred in some applications.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A method for fabricating field emission devices, the method comprising the steps of:

attaching to a manipulator a substrate that has an insulative layer sandwiched between a top and a bottom conductive layer, wherein said top conductive layer has an array of submicron holes beneath which are cavities in said insulative layer that extend down to the bottom conductive layer;

positioning a metal deposition source near said substrate on the side of said top conductive layer with said array of holes;

inserting between said substrate and said metal deposition source a shield with an aperture through which a spray of metal from said metal deposition source is allowed to pass to the substrate to form a first set of field emission cathodes in the form of metal cones on said bottom conductive layer in a first group of said cavities;

moving said substrate with said manipulator such that said spray of metal from said metal deposition source through said aperture is allowed to pass to the substrate to form a second set of field emission cathodes, apart from said first set, in the form of metal cones on said bottom conductive layer in a second group of said cavities;

moving said substrate with said manipulator such that said spray of metal from said metal deposition source through said aperture is allowed to pass to the substrate to form a subsequent set of field emission cathodes, apart from any previous sets, in the form of metal cones on said bottom conductive layer in subsequent groups of said cavities until all such cavities have formed in them a field emission cathode.

2. A system for fabricating field emission devices, the system comprising:

means for manipulating a substrate that has an insulative layer sandwiched between a top and a bottom conductive layer, wherein said top conductive layer has an array of submicron holes beneath which are cavities in said insulative layer that extend down to the bottom conductive layer;

a metal deposition source positioned near said substrate on the side of said top conductive layer with said array of holes; and a shield with an aperture inserted between said substrate and said metal deposition source through which a spray of metal from said metal deposition source is allowed to pass to the substrate to form a first set of field emission cathodes in the form of metal cones on said bottom conductive layer in a first group of said cavities;

wherein said substrate is moved by the means for manipulating such that said spray of metal from said metal deposition source through said aperture is allowed to pass to the substrate to form a second set of field emission cathodes, apart from said first set, in the form of metal cones on said bottom conductive layer in a second group of said cavities; and wherein said substrate is moved by the means for manipulating such that said spray of metal from said metal deposition source through said aperture is allowed to pass to the substrate to form a subsequent set of field emission cathodes, apart from any previous sets, in the form of metal cones on said bottom conductive layer in subsequent groups of said cavities until all such cavities have formed in them a field emission cathode.

3. A system for fabricating field emission devices, comprising:

a manipulator for attachment and control of a substrate that has an insulative layer sandwiched between a top and a bottom conductive layer, wherein said top conductive layer has an array of submicron holes beneath which are cavities in said insulative layer that extend down to the bottom conductive layer;

a metal deposition source positioned near said substrate on the side of said top conductive layer with said array of holes; and a shield with an aperture inserted between said substrate and said metal deposition source through which a spray of metal from said metal deposition source is allowed to pass to the substrate to form a plurality of sets of field emission cathodes, one set at a time, in the form of metal cones on said bottom conductive layer in a corresponding successive group of said cavities.

4. The system of claim 3, wherein:

the metal deposition source is an electron-beam evaporative source;

said substrate is placed three to twelve inches away from the metal deposition source, with 3.5 to 6.5 inches being optimal;

the shield is positioned less than two inches from said substrate, with 0.50 inches, plus or minus 0.25 inches, being optimal;

said aperture is 0.25 to 1.50 inches in diameter, with 0.75 inches, plus or minus 0.25 inches, being optimal; and said aperture is not necessarily round, wherein different shapes produce field emission cathodes with different characteristics.

* * * * *

UNITED STATES PATENT AND TRADEMARK OFFICE

CERTIFICATE OF CORRECTION

PATENT NO. : 5,746,634

DATED : May 5, 1998

INVENTOR(S) : Jankowski, et al.

It is certified that error appears in the above-identified patent and that said Letters Patent is hereby corrected as shown below:

Column 5, line 8, delete ", with 3.5 to 6.5 inches".
Column 5, line 9, delete "being optimal".
Column 6, line 2, delete ", with 0.50 inches, plus or minus 0.25 inches,".
Column 6, line 3, delete "being optimal".
Column 6, line 4, delete ", with 0.75".
Column 6, line 5, delete " inches, plus or minus 0.25 inches, being optimal"

Add new claim 5:

5. The system of claim 3, wherein:
the metal deposition source is an electron- beam evaporative source;
said substrate is placed 3.5 to 6.5 inches away from the metal deposition source;
the shield is positioned 0.50 $\pm$ 0.25 inches from said substrate;
said aperture is 0.75 $\pm$ 0.25 inches in diameter; and
said aperture is not necessarily round, wherein different shapes produce field emission cathodes with different characteristics.

Signed and Sealed this

Ninth Day of February, 1999

*Attest:*

*Attesting Officer*

*Acting Commissioner of Patents and Trademarks*